US010966524B2

(12) United States Patent
Wang et al.

(10) Patent No.: US 10,966,524 B2
(45) Date of Patent: Apr. 6, 2021

(54) FLEXIBLY PARTITIONED DRAWER AND REFRIGERATOR HAVING FLEXIBLY PARTITIONED DRAWER

(71) Applicant: QINGDAO HAIER CO., LTD., Qingdao (CN)

(72) Inventors: Ning Wang, Qingdao (CN); Dong Wei, Qingdao (CN); Jian Zhang, Qingdao (CN); Guangrui Wu, Qingdao (CN); Bin Fei, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 0 days.

(21) Appl. No.: 16/643,555

(22) PCT Filed: Apr. 29, 2019

(86) PCT No.: PCT/CN2019/084996

§ 371 (c)(1),
(2) Date: Feb. 29, 2020

(87) PCT Pub. No.: WO2020/024636

PCT Pub. Date: Feb. 6, 2020

(65) Prior Publication Data

US 2020/0196754 A1 Jun. 25, 2020

(30) Foreign Application Priority Data

Aug. 3, 2018 (CN) ..... 201810875487.6

(51) Int. Cl.
*A47B 88/975* (2017.01)
*F25D 25/02* (2006.01)

(52) U.S. Cl.
CPC ..... *A47B 88/975* (2017.01); *F25D 25/025* (2013.01); *F25D 2325/00* (2013.01)

(58) Field of Classification Search
CPC ... A47B 88/969; A47B 88/975; F25D 25/022; F25D 25/025

(Continued)

(56) References Cited

U.S. PATENT DOCUMENTS 5,779,331 A * 7/1998 Fox ..... B42F 17/12 211/55
2013/0063014 A1* 3/2013 Chen ..... A47B 88/90 312/348.3

(Continued)

FOREIGN PATENT DOCUMENTS

CN 108253722 A 7/2018
CN 109708409 A 5/2019

(Continued)

*Primary Examiner* — James O Hansen
(74) *Attorney, Agent, or Firm* — Cheng-Ju Chiang

(57) ABSTRACT

A flexibly partitioned drawer comprises a drawer body formed with an accommodating cavity and at least one partitioning member that moves left and right and is disposed in the accommodating cavity for use in partitioning the accommodating cavity. Leading and trailing ends of the dividing member respectively protrude in the direction of front and rear walls of the drawer body to form protruding portions. The front and rear walls of the drawer body are respectively formed thereon with sliding grooves that cooperate with corresponding side protruding portions so as to provide the dividing member with movement along the left and right directions. The sliding grooves penetrate side walls of the drawer body such that the accommodating cavity communicates with an outer part of the drawer body.

15 Claims, 5 Drawing Sheets

(58) Field of Classification Search
USPC ..... 312/401, 404, 402, 330.1, 348.3
See application file for complete search history.

(56) References Cited

U.S. PATENT DOCUMENTS

| | | | | |
|---|---|---|---|---|
| 2014/0265802 | A1 | 9/2014 | Wilcox et al. | |
| 2014/0312759 | A1* | 10/2014 | Song | F25D 23/069 312/405.1 |
| 2015/0069066 | A1* | 3/2015 | Choi | F25D 25/022 220/533 |

FOREIGN PATENT DOCUMENTS

| | | | |
|---|---|---|---|
| CN | 109708410 | A | 5/2019 |
| CN | 109708411 | A | 5/2019 |
| CN | 109708412 | A | 5/2019 |
| WO | 2015/090474 | A1 | 6/2015 |

* cited by examiner

FLEXIBLY PARTITIONED DRAWER AND REFRIGERATOR HAVING FLEXIBLY PARTITIONED DRAWER

The present application is a 35 U.S.C. § 371 National Phase conversion of International (PCT) Patent Application No. PCT/CN2019/084996, filed on Apr. 29, 2019, which claims the priority to the Chinese Patent Application No. 201810875487.6, filed on Aug. 3, 2018, and titled "Flexibly Partitioned Drawer and Refrigerator Having Flexibly Partitioned Drawer", which is incorporated herein by reference in its entirety. The PCT International Patent Application was filed and published in Chinese.

TECHNICAL FIELD

The present invention relates to the field of refrigerator designs, and in particular, to a flexibly partitioned drawer and a refrigerator having the same.

BACKGROUND

Usually, a refrigerator is provided therein with a drawer for storing articles. In order to take full advantage of storage spaces in the drawer, in a prior design, the drawer in some of the refrigerators is provided therein additionally with partitioning members for further dividing the drawer into a plurality of areas. However, usually, the partitioning members in the current drawer are connected fixedly with a drawer body. As such, a user may not adjust a proportion of each area according to actual demands. In addition, in the existing drawer with partitioning members, usually, the drawer includes longitudinal and transverse partitioning members. When the refrigerator is in use, due to habits of the user, usually, the divided areas at an inner side of the drawer may not be taken effective advantage; moreover, some articles with great lengths cannot be fitted in the drawer divided longitudinally and transversely at the same time.

In view of this, it is necessary to provide an improved drawer to solve the above-mentioned problems.

SUMMARY

The present invention is intended to at least solve one of the technical problems in a prior art. In order to achieve the above-mentioned inventive object, the present invention provides a flexibly partitioned drawer and a refrigerator having the same, specific designs of which are as follows.

A flexibly partitioned drawer comprises a drawer body with an accommodating cavity and at least one partitioning member moving in the accommodating cavity along a left-and-right direction for dividing the accommodating cavity, wherein leading and trailing ends of the partitioning member protrude towards front and rear walls of the drawer body respectively to form protruding portions, and sliding grooves fitted with the protruding portions on corresponding sides for the partitioning member to move left and right are formed on the front and rear walls of the drawer body respectively, and penetrate through the side walls of the drawer body to communicate the accommodating cavity to an exterior of the drawer body.

Further, the flexibly partitioned drawer further comprising two sliding bars fixed outside the front and rear walls of the drawer body respectively and guiding the partitioning member to move, wherein a slider connected with the protruding portion fixedly is slidably arranged on each sliding bar.

Further, the slider comprises a sliding portion for the sliding bar to pass through and a fixing portion provided on a lower side of the sliding portion and connected with the protruding portion fixedly.

Further, a strip-shaped rod in a direction consistent with a length direction of the sliding bar is provided on the protruding portion outside the drawer body, and a slot where the strip-shaped rod is insert fixedly is formed on the fixing portion.

Further, the protruding portion further has a connecting rod passing through the slot to connect the partitioning member with the strip-shaped rod, and a buckle for buckling the connecting rod after the strip-shaped rod is inserted into the slot is provided at an end of the slider where the strip-shaped rod is inserted.

Further, the sliding portion comprises two lugs fixedly arranged at intervals, and sliding holes for the sliding bar to pass through are formed on the two lugs.

Further, the partitioning member comprises a spacer and a frame provided around the spacer and connected with the spacer fixedly, and the frame is molded integrally with the protruding portions on corresponding sides respectively at leading and trailing ends of the partition.

Further, a control portion for moving the partitioning member left and right is fixed on the frame in a middle of an upper side of the partition.

Further, two partitioning members are provided in the accommodating cavity in parallel.

The present invention further provides a refrigerator comprising a cabinet, the flexibly partitioned drawer is provided in the cabinet.

The prevent invention has the following beneficial effects. Based on a structure of the flexibly partitioned drawer according to the present invention, the user may adjust positions of the partitioning members according to actual requirements in usage to allocate each area of an accommodating cavity of the drawer reasonably; in addition, in the case where the flexibly partitioned drawer is applied to the refrigerator, since the accommodating cavity only has the partitioning members moving left and right, the user may well use the inner side space of the accommodating cavity of the drawer; further, sliding grooves provided on the drawer body for the partitioning members to move may serve as passages for refrigerating air in a cabinet to enter the accommodating cavity of the drawer, thereby facilitating storage of the articles in the accommodating cavity of the drawer.

DETAILED DESCRIPTION

The present invention is below described in detail in combination with each implementation structure illustrated in drawings. FIGS. 1-9 show a preferable embodiment of the present invention.

Figure 1:
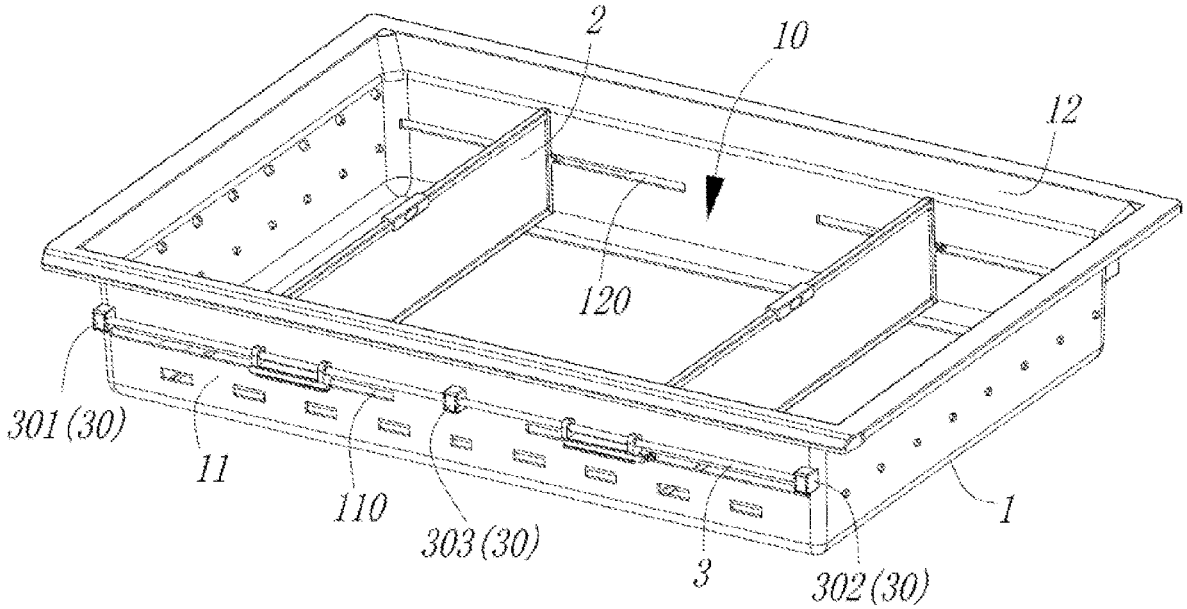
FIG. 1 shows a schematic perspective diagram of a flexibly partitioned drawer according to the present invention.

Referring to FIG. 1, the flexibly partitioned drawer according to the present invention includes a drawer body 1 with an accommodating cavity 10, further including at least one partitioning member 2 which moves in the accommodating cavity 10 along a left-and-right direction for dividing the accommodating cavity 10. Specifically, in the present embodiment, two partitioning members 2 are provided in the accommodating cavity 10 in parallel and may divide the accommodating cavity 10 into three storage areas with adjustable spaces. When the present flexibly partitioned drawer is in use, the two partitioning members 2 may further be attached to left and right side walls of the drawer body 1 respectively, thereby enabling the accommodating cavity 10 in the drawer body 1 to form a large continuous accommodating space.

Figure 5:
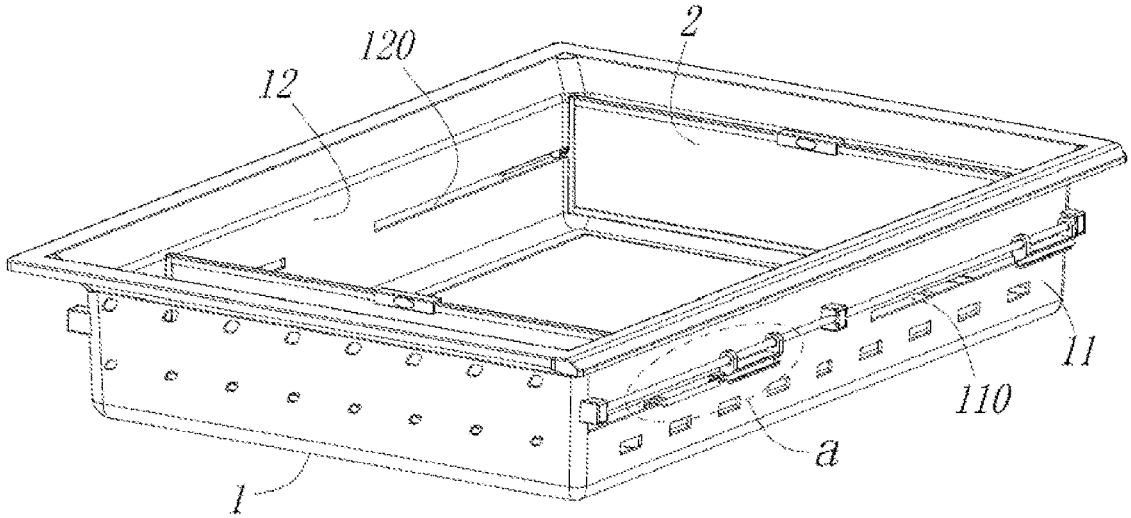
FIG. 5 shows a schematic diagram before the partitioning member is assembled to a slider in the flexibly partitioned drawer.
Figure 6:
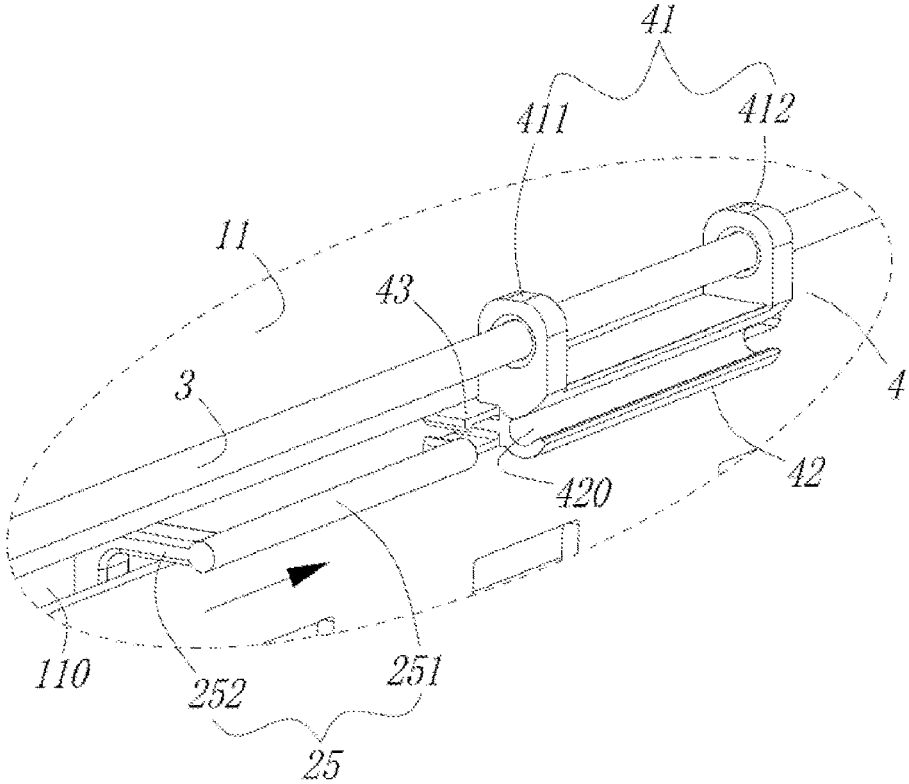
FIG. 6 shows a schematic enlarged diagram of portion a in FIG. 5.

Referring to FIGS. 1, 5 and 6, leading and trailing ends of the partitioning member in the present invention protrude towards front and rear walls 11 and 12 of the drawer body 1 respectively to form protruding portions 25, and sliding grooves, fitted with the protruding portions 25 on corresponding sides for the partitioning members 2 to move left and right, are formed on the front and rear walls 11 and 12 of the drawer body 1 respectively. Specifically, in the present embodiment, the sliding grooves include a first sliding groove 110 provided on the front wall 11 and a second sliding groove 120 provided on the rear wall 12.

In the present invention, the first and second sliding grooves 110 and 120 penetrate through the front and rear walls 11 and 12 of the drawer body 1 respectively to communicate the accommodating cavity 10 to an exterior of the drawer body 1.

The invention further provides a refrigerator, including a cabinet (not shown) and the flexibly partitioned drawer according to the present invention.

Based on the structure of the flexibly partitioned drawer according to the present invention, the user may adjust positions of the partitioning members 2 according to the actual requirements in usage to allocate each area of the accommodating cavity 10 of the drawer reasonably; in addition, in the case where the flexibly partitioned drawer is applied to the refrigerator, since the accommodating cavity 10 only has the partitioning members 2 moving left and right, the user may better use the inner side space of the accommodating cavity 10; sliding grooves provided on the drawer body for the partitioning members to move may serve as passages for refrigerating air in a cabinet to enter the accommodating cavity of the drawer, thereby facilitating storage of the articles in the accommodating cavity of the drawer.

The flexibly partitioned drawer according to the present invention has a more detailed structure described as follows.

Figure 2:
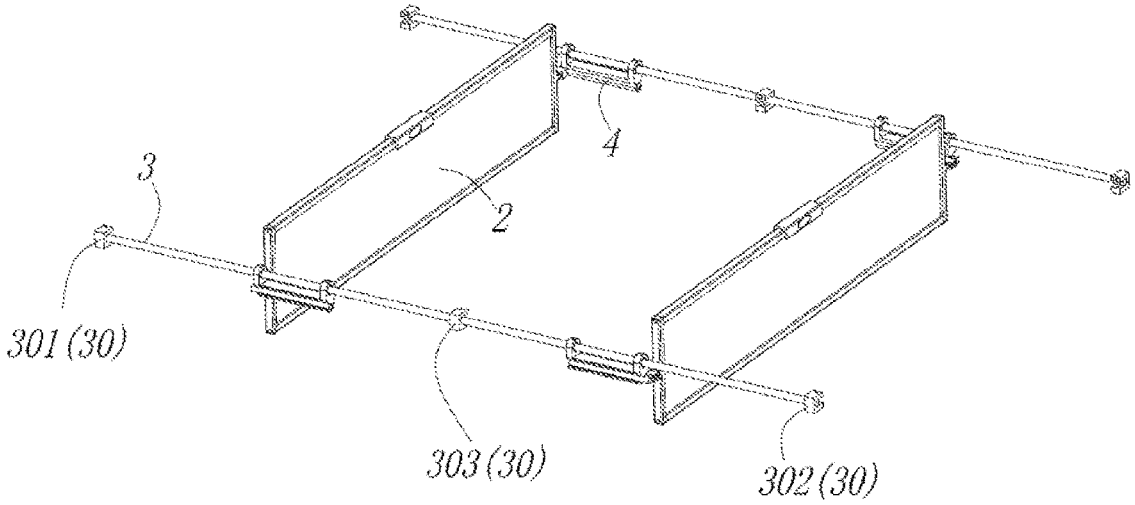
FIG. 2 shows a schematic diagram of the structure shown in FIG. 1 with a drawer body removed.

Referring to FIGS. 1 and 2, the flexibly partitioned drawer further includes two sliding bars 3 fixed to front and rear walls 11 and 12 of the drawer body 1 respectively and guiding the partitioning members 2 to move. In the process of using the flexibly partitioned drawer according to the present invention, the sliding bar 3 also functions as a stiffener for sharing a pressure borne when articles are stored in the drawer body 1, thereby reducing deformation of the drawer body 1 when bearing a weight effectively and lowering a probability of damage to the drawer body 1.

In the present embodiment, three fixing projections 30 configured for fixing the sliding bars 3 are provided outside the front and rear walls 11 and 12 of the drawer body 1 in a length direction of the sliding bars 3 at intervals respectively. Referring to FIGS. 1 and 2 specifically, outside the front wall 11, the first, second and third fixing projections 301, 302 and 303 are provided on a left side, a middle part and a right side of the front wall 11 successively, for fixing a left end, a middle part and a right end of the sliding bar 3 respectively. With the three fixing projections 30, the sliding bars 3 may function as the stiffeners well, without affecting independent operation of the two partitioning members 2.

Figure 7:
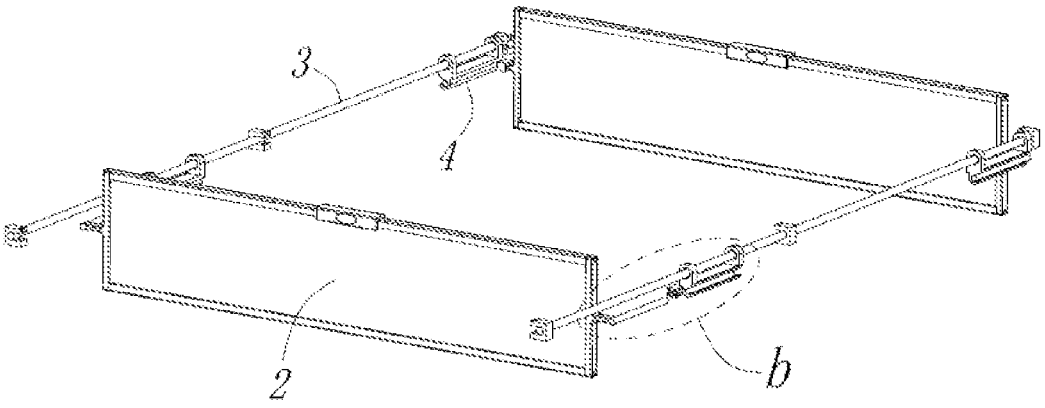
FIG. 7 shows a schematic diagram of the structure shown in FIG. 5 with the drawer body removed.
Figure 8:
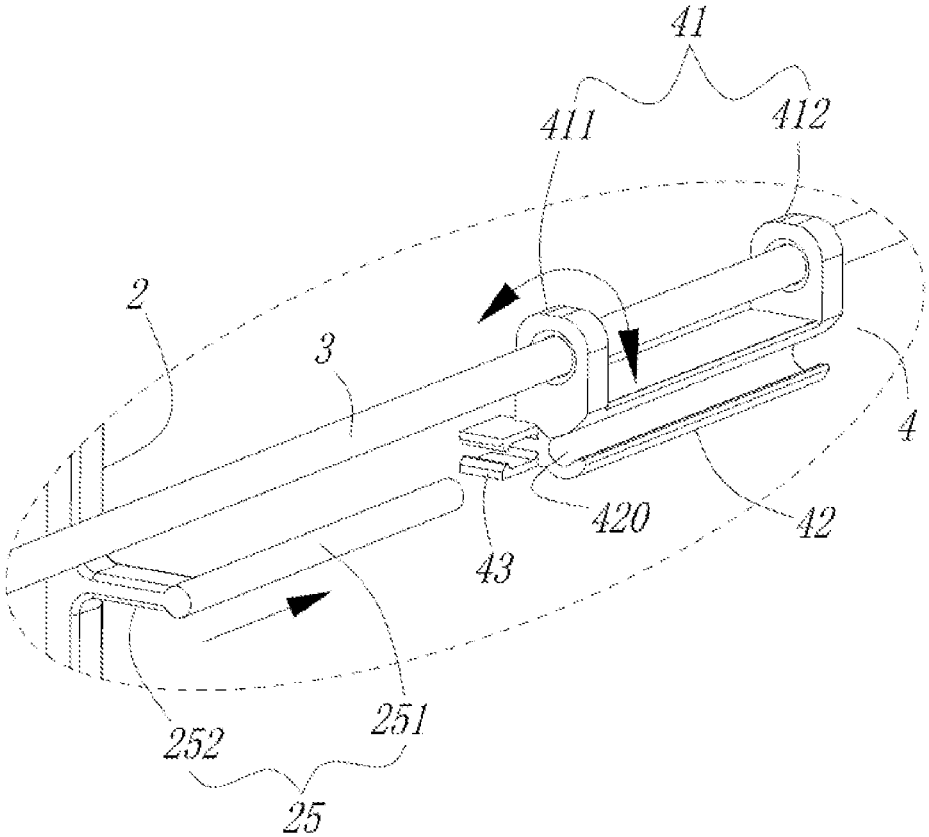
FIG. 8 shows a schematic enlarged diagram of portion b in FIG. 7.
Figure 9:
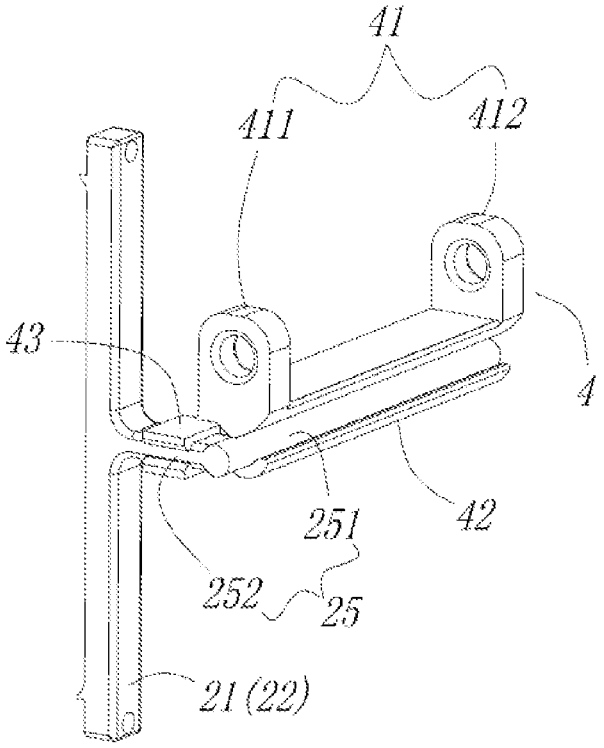
FIG. 9 shows a schematic diagram in which a protruding portion of the partitioning member is fitted with the slider.

Referring to FIGS. 7, 8 and 9, a slider 4 connected with the protruding portion 25 fixedly is slidably arranged on the sliding bar 3. Based on the fixed connection between the protruding portion 25 and the slider 4, the partitioning member 2 is in sliding fit on the sliding bars 3, such that the partitioning member 2 may move in the length direction of the sliding bars 3.

In a process of assembling the protruding portions 25 of the partitioning member 2 to the sliders 4, the protruding portions 25 at leading and trailing ends of the partitioning member 2 pass through the sliding grooves on the front and rear walls 11 and 12 of the drawer body 1 from an interior of the accommodating cavity 10, and then are connected with the sliders 4 on corresponding outer sides of the drawer body 1 fixedly. When the partitioning members 2 are required to be removed from the drawer body 1 to be cleaned, the above assembling process is executed reversely. The way of assembly of the partitioning members 2 and the sliders 4 in the flexibly partitioned drawer 2 in the present invention simplifies an assembling process greatly and facilitates operation of the user.

As a preferable embodiment of the present invention, referring to FIG. 8, before the protruding portion 25 is connected to the slider 4 fixedly, the slider 4 is rotated on the sliding bar 3 adjustably. Based on the structure, each member of the flexibly partitioned drawer has lowered requirements for accuracy of manufacture. In other words, when the partitioning member 2 is connected onto the sliders 4 fixedly, in case of a certain size deviation of the partitioning member 2, the sliders 4 may be adapted to the deviation by rotating by a certain angle around the sliding bars 3, without twisting related structures when the partitioning member 2 is connected with the sliders 4 fixedly, thereby guaranteeing smooth sliding of the partitioning members 2 on the sliding bars 3 after assembly.

In the present invention, each slider 4 includes a sliding portion 41 for the sliding bar 3 to pass through and a fixing portion 42 provided on a lower side of the sliding portion 41 and connected with the protruding portion 25 fixedly.

In the present embodiment, referring to FIGS. 5 and 6, the protruding portion 25 has a strip-shaped rod 251 in a direction consistent with the length direction of the sliding bar 3 outside the drawer body 1; referring to FIGS. 8 and 9, a slot 420 where the strip-shaped rod 251 is inserted fixedly is formed on the fixing portion 42.

Further, referring to FIGS. 6 and 8, the protruding portion 25 in the present embodiment further has a connecting rod 252 passing through the sliding groove to connect the partitioning member 2 with the strip-shaped rod 251, and a buckle 43 is provided at an end of the slider 4 where the strip-shaped rod 251 is inserted. Referring to FIG. 9, after the strip-shaped rod 251 is inserted into the slot 420, the connecting rod 252 is buckled by the buckle 43, thereby locking a position relationship between the partitioning member 2 and the slider 4. During the specific implementation, the buckle 43 includes a pair of opposite clamping sheets (not shown) up and down, a space where the connecting rod 252 is embedded fixedly is formed in the two clamping sheets, and projections (not shown) configured for preventing the connecting rod 252 from being disengaged from the slider 4 are formed at heads of the two clamping sheets.

Referring to FIG. 9, the sliding portion 41 in the present embodiment includes two lugs arranged fixedly at intervals, i.e., first and second lugs 411 and 412, and sliding holes (not shown) for the sliding bar 3 to pass through are formed on both the first and second lugs 411 and 412. The arrangement of the two lugs may guarantee stable sliding of the sliders 4 on the sliding bar 3.

During the specific implementation, in order to enable the sliders 4 to rotate around the sliding bar 3 before assembly, the sliding holes on the lugs and the sliding bars 3 all have circular cross sections.

Figure 3:
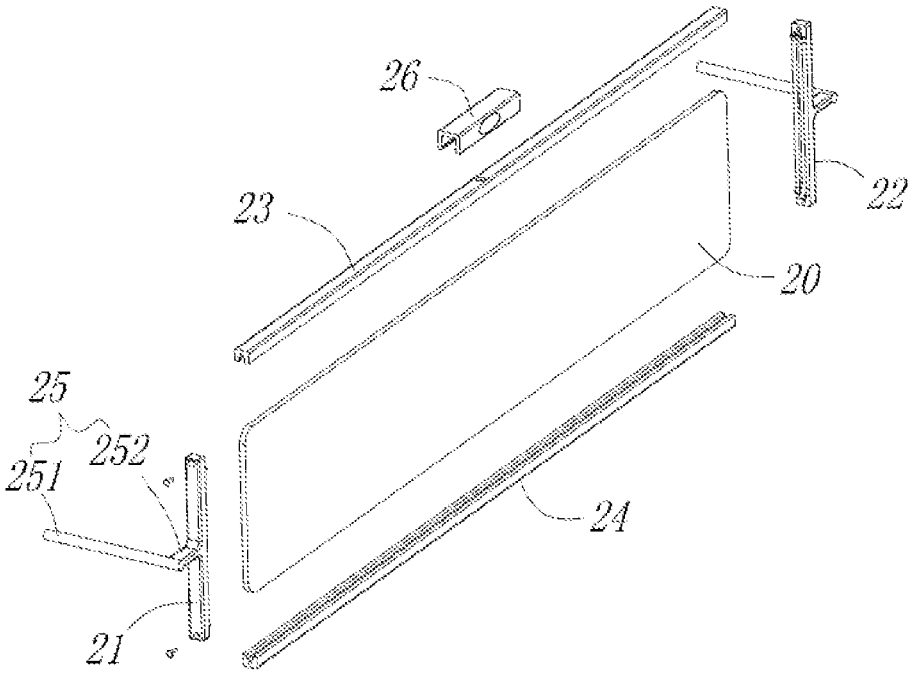
FIG. 3 shows a schematic exploded diagram of a partitioning member.
Figure 4:
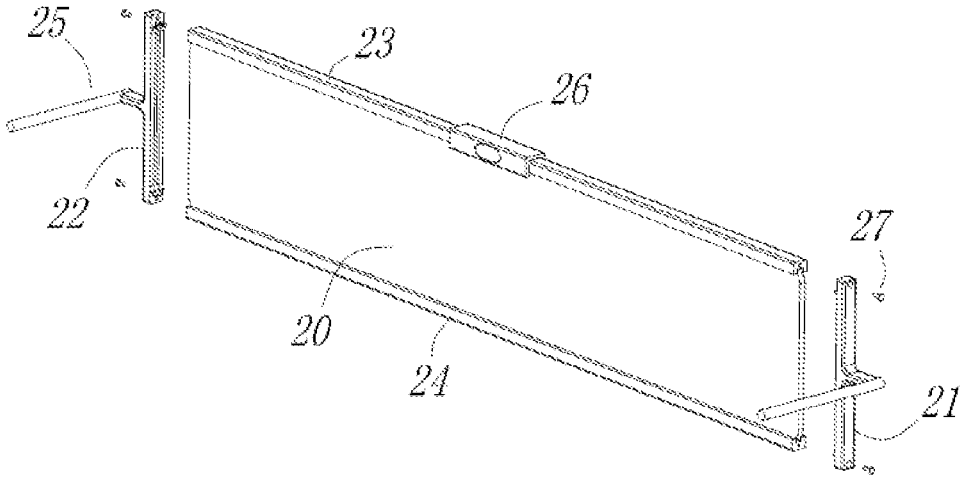
FIG. 4 shows a schematic diagram of an assembly process for the partitioning member.

Referring to FIGS. 3 and 4, in a specific embodiment of the present invention, the partitioning member 2 includes a spacer 20 and a frame provided around the spacer 20 and connected with the spacer 20 fixedly, wherein, the spacer 20 is rectangular.

Specifically, the frame has end components located at leading and trailing ends, i.e., first and second end components 21 and 22 shown in drawings. In the present embodiment, the first and second end components 21 and 22 are molded integrally with the protruding portions 25 on the corresponding sides respectively; as a preferable embodiment of the present invention, the first and second end components 21 and 22 are molded integrally with the protruding portions 25 on the corresponding sides by an injection molding process respectively. The integrally molding process applied to the end components and the protruding portions 25 may simplify an assembly flow of the partitioning members 2, and thus improve an assembly efficiency of the flexibly partitioned drawer.

The frame in the present embodiment further has side components located on the upper and lower sides of the spacer 20, i.e., upper and lower side components 23 and 24 shown in drawings, both of which are molded by an extrusion process. Due to regular shapes, the upper and lower side components 23 and 24 may be manufactured in bulk rapidly by the extrusion process, thereby improving the production efficiency effectively.

The first and second end components 21 and 22 in the present embodiment are fastened to two ends of the upper and lower side components 23 and 24 by means of screws 27, which is simple in terms of structure and easy to implement. In order to fix the spacer 20 well, grooves (not labeled) where the spacer 20 is inserted fixedly are formed at inner sides of the first and second end components 21 and 22 as well as the upper and lower side components 23 and 24 respectively.

In order to facilitate the user to adjust a position of the spacer 20 in the accommodating cavity, a control portion 26 for moving the partitioning member 2 left and right is fixed to a middle part of the upper side component 23 in the present embodiment.

It may be understood that the left and right direction in the present invention is consistent with the length direction of the sliding bar 3, and descriptions involving orientations, such as front, rear, or the like, may all refer to push and pull directions of the flexibly partitioned drawer in the refrigerator.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

So far, a person skilled in the art shall know that although a plurality of exemplary embodiments of the present invention have been described above in detail, various variations and improvements can be directly determined or deducted from the content disclosed by the present invention without departing from the spirit and scope of the present invention. Therefore, all those variations and improvements shall be deemed to be covered by the scope of the present invention.

What is claimed is:

1. A flexibly partitioned drawer, comprising a drawer body with an accommodating cavity, further comprising at least one partitioning member moving in the accommodating cavity along a left-and-right direction for dividing the accommodating cavity, wherein leading and trailing ends of the partitioning member protrude towards front and rear walls of the drawer body respectively to form protruding portions, and sliding grooves fitted with the protruding portions on corresponding sides for the partitioning member to move left and right are formed on the front and rear walls of the drawer body respectively, and penetrate through the front and rear walls of the drawer body to communicate the accommodating cavity to an exterior of the drawer body; two sliding bars are fixed outside the front and rear walls of the drawer body respectively and are guiding the partitioning member to move, a slider connected with the protruding portion fixedly is slidably arranged on each sliding bar;

wherein the slider comprises a sliding portion for the sliding bar to pass through and a fixing portion provided on a lower side of the sliding portion and connected with the protruding portion fixedly; and wherein a strip-shaped rod in a direction consistent with a length direction of the sliding bar is provided on the protruding portion outside the drawer body, and a slot where the strip-shaped rod is insert fixedly is formed on the fixing portion.

2. The flexibly partitioned drawer according to claim 1, wherein the protruding portion further has a connecting rod passing through the slot to connect the partitioning member with the strip-shaped rod, and a buckle for buckling the connecting rod after the strip-shaped rod is inserted into the slot is provided at an end of the slider where the strip-shaped rod is inserted.

3. The flexibly partitioned drawer according to claim 2, wherein two stiffener are fastening to front and rear walls of the drawer body respectively and served as the sliding bars.

4. The flexibly partitioned drawer according to claim 3, wherein the connecting rod is perpendicular to the strip-shaped rod, and exposed outside the drawer body.

5. The flexibly partitioned drawer according to claim 1, wherein the sliding portion comprises two lugs fixedly arranged at intervals, and sliding holes for the sliding bar to pass through are formed on the two lugs.

6. The flexibly partitioned drawer according to claim 5, wherein the sliding holes and the slide bars all have circular cross sections.

7. The flexibly partitioned drawer according to claim 1, wherein the partitioning member comprises a spacer and a frame provided around the spacer and connected with the spacer fixedly, and the frame is molded integrally with the protruding portions on corresponding sides respectively at leading and trailing ends of the partition.

8. The flexibly partitioned drawer according to claim 7, wherein a control portion for moving the partitioning member left and right is fixed on the frame in a middle of an upper side of the partition.

9. The flexibly partitioned drawer according to claim 1, wherein two partitioning members are provided in the accommodating cavity in parallel.

10. The flexibly partitioned drawer according to claim 9, wherein three fixing projections configured for fixing each sliding bar are provided outside the front and rear walls of the drawer body in the length direction of the sliding bar at intervals respectively, and are fixed to two ends and a middle part of each sliding bar respectively.

11. The flexibly partitioned drawer according to claim 10, wherein both of the front wall and the rear wall define two sliding grooves spaced apart from each other along a length direction of the sliding bar, and two sliders on a same side of the drawer body are connected with two sliding grooves with a one-to-one relationship slidably.

12. A flexibly partitioned drawer, comprising a drawer body with an accommodating cavity, further comprising at least one partitioning member moving in the accommodating cavity along a left-and-right direction and configured for dividing the accommodating cavity, wherein one partitioning member comprises a rectangular spacer and a frame provided around the spacer and connected with the spacer fixedly, the frame has end components located at front and rear ends, the end component protrudes towards a direction apart from the drawer body to form protruding portions, and are molded integrally with the protruding portion by an injection molding process, and sliding grooves fitted with the protruding portions on corresponding sides for the divider to move left and right are formed on the front and rear side walls of the drawer body respectively; and two sliding bars fixed outside the front and rear walls of the drawer body respectively and guiding the partitioning member to move, wherein a slider connected with the protruding portion fixedly is slidably arranged on each sliding bar;

wherein the slider comprises a sliding portion for the sliding bar to pass through and a fixing portion provided on a lower side of the sliding portion and connected with the protruding portion fixedly; and the protruding portion is provided with a strip-shaped rod extending along a length direction of the sliding bar, the strip-shaped rod is located outside the drawer body and fixed in a slot of the fixing portion.

13. The flexibly partitioned drawer according to claim 12, wherein the frame further has side components which are located on upper and lower sides of the partition and are molded by an extrusion process.

14. The flexibly partitioned drawer according to claim 13, wherein grooves where the spacer is inserted and fixed in are formed at inner sides of the end and side components.

15. A flexibly partitioned drawer, comprising a drawer body with an accommodating cavity, further comprising at least one partitioning member moving in the accommodating cavity along a left-and-right direction for dividing the accommodating cavity, wherein leading and trailing ends of the partitioning member protrude towards front and rear walls of the drawer body respectively to form protruding portions, and sliding grooves fitted with the protruding portions on corresponding sides for the partitioning member to move left and right are formed on the front and rear walls of the drawer body respectively, and penetrate through the front and rear walls of the drawer body to communicate the accommodating cavity to an exterior of the drawer body; two sliding bars are fixed outside the front and rear walls of the drawer body respectively and are guiding the partitioning member to move, a slider connected with the protruding portion fixedly is slidably arranged on each sliding bar;

wherein two partitioning members are provided in the accommodating cavity in parallel; and wherein three fixing projections configured for fixing each sliding bar are provided outside the front and rear walls of the drawer body in the length direction of the sliding bar at intervals respectively, and are fixed to two ends and a middle part of each sliding bar respectively.

* * * * *